US006000658A

United States Patent [19]

McCall, Jr.

[11] Patent Number: 6,000,658

[45] Date of Patent: Dec. 14, 1999

[54] TOILET PAPER DISPENSER

[76] Inventor: Tommie McCall, Jr., 7249 S. Oakley, Chicago, Ill. 60636

[21] Appl. No.: 09/059,994

[22] Filed: Apr. 13, 1998

[51] Int. Cl.[6] ..... B65H 16/06

[52] U.S. Cl. ..... 242/599; 242/564.2; 242/590; 242/598.6; 242/905; 4/300.1; D6/519

[58] Field of Search ..... 242/564.2, 563, 242/590, 596.8, 597.8, 598.5, 598.6, 599, 905; 4/300.1; 312/34.8; D6/519

[56] References Cited

U.S. PATENT DOCUMENTS

| | | | |
|---|---|---|---|
| D. 91,541 | 2/1934 | Pedersen | D6/519 |
| D. 214,839 | 8/1969 | Louis | D6/519 |
| 2,546,820 | 3/1951 | Grant | 242/905 |
| 2,639,939 | 5/1953 | Matchett | 242/905 |
| 2,746,798 | 5/1956 | Wardell, Jr. | 242/905 |
| 3,347,480 | 10/1967 | Abramoff . | |
| 3,587,437 | 6/1971 | McEwen et al. . | |
| 4,056,228 | 11/1977 | Rosenkrantz et al. . | |
| 4,168,550 | 9/1979 | Lindauer . | |
| 4,209,864 | 7/1980 | Lindauer . | |
| 4,434,938 | 3/1984 | Rosenkrantz et al. . | |
| 4,684,075 | 8/1987 | Francis | 242/597.8 |
| 4,770,679 | 9/1988 | Slaughter | 242/598.6 |
| 4,834,316 | 5/1989 | DeLorean | 242/594.5 |
| 5,016,781 | 5/1991 | Ten Wolde . | |
| 5,359,738 | 11/1994 | Kurtz . | |
| 5,390,833 | 2/1995 | Baumann . | |
| 5,598,954 | 2/1997 | Salzano . | |
| 5,660,313 | 8/1997 | Newbold . | |

*Primary Examiner*—Donald P. Walsh
*Assistant Examiner*—Emmanuel M. Marcelo
*Attorney, Agent, or Firm*—Michael R. McKenna

[57] ABSTRACT

A toilet paper dispenser in which a roll of toilet paper is supported on a rotatable spindle with a music box activated by rotation of the spindle. The toilet paper dispenser is equipped with an aromatic fragrance dispenser which is automatically activated by rotation of the spindle.

22 Claims, 2 Drawing Sheets

TOILET PAPER DISPENSER

BACKGROUND OF THE INVENTION

This invention relates to a combined toilet tissue and music dispenser in which music is played in response to the withdrawal of the toilet tissue. Additionally, the device of the instant invention now for the first time provides a simple and easy device for toilet paper dispensing device that automatically dispenses music, an air freshener, and light which is particularly helpful at night.

Alternative technology is available in the form of U.S. Pat. No. 5,660,313 which was issued for pre-moistened toilet paper and dispenser, said toilet paper 1% may be perfumed.

An aromatic system is disclosed in U.S. Pat. No. 4,434,938, where the fragrance is discharged in connection with the flushing of the toilet. Similar objectives are obtained in U.S. Pat. Nos. 4,056,228; 4,209,864; and 4,168,550. Additionally, a toilet tissue wetting device is disclosed in U.S. Pat. No. 5,359,738 which said device interconnected with the water closet tank.

Deodorizer dispensing devices are disclosed in U.S. Pat. Nos. 5,598,954 and 5,016,781 and 5,390,833, none of the foregoing relate to toilet paper actuating systems.

None of the foregoing inventions is designed to automatically activate music, and light or fragrance upon removal of toilet paper.

To alleviate this problem, and others which will become apparent from the disclosure which follows, the present invention conveniently and automatically provides music which is played in response to the withdrawal of the toilet tissue.

This wonderful innovative way of dispensing toilet tissue is functional and entertaining. It conveniently provides music by tape or radio, providing an aromatic dispenser to cure bathroom odors and automatically actuated night light—all activated by the rolling of the toilet paper.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices, now for the first time a simple and easy to use toilet paper dispenser has been created which automatically plays music, creates fresh air scents, and provides lighting during a preselected interval while the toilet area is in use.

The aromatic substance may be a perfumed base for the purpose of deodorizing the toilet area thus providing pleasant smell.

Preferably the housing of the dispenser would conceal the toilet paper while mounted on the spindle.

The bathroom fixture of the present invention exhibits important distinctions over similar fixtures heretofore known. For example, the roll of tissue is completely concealed while in position for use. The provision of the music source and light source actuated by rotation of the tissue roll is a distinct improvement over tissue dispensers of the prior art.

Still other advantages will be apparent from the disclosure that follows.

SUMMARY OF THE INVENTION

The present invention discloses an improved toilet paper dispenser of the type in which a roll of toilet paper is supported on a rotatable spindle secured at each end thereof by a bracket, and wherein the improvement comprises a music box operatively connected to the spindle and activated by rotation of the spindle. A timer is provided to deactivate the music box after a period of time has elapsed. Additionally, the present invention is equipped with means for dispensing an aromatic fragrance which is operably connected to the spindle.

The improved toilet paper dispenser further comprising a nightlight operatively connected to the spindle which may be activated by rotation of the spindle. Furthermore, the night light may have an independent on/off switch.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
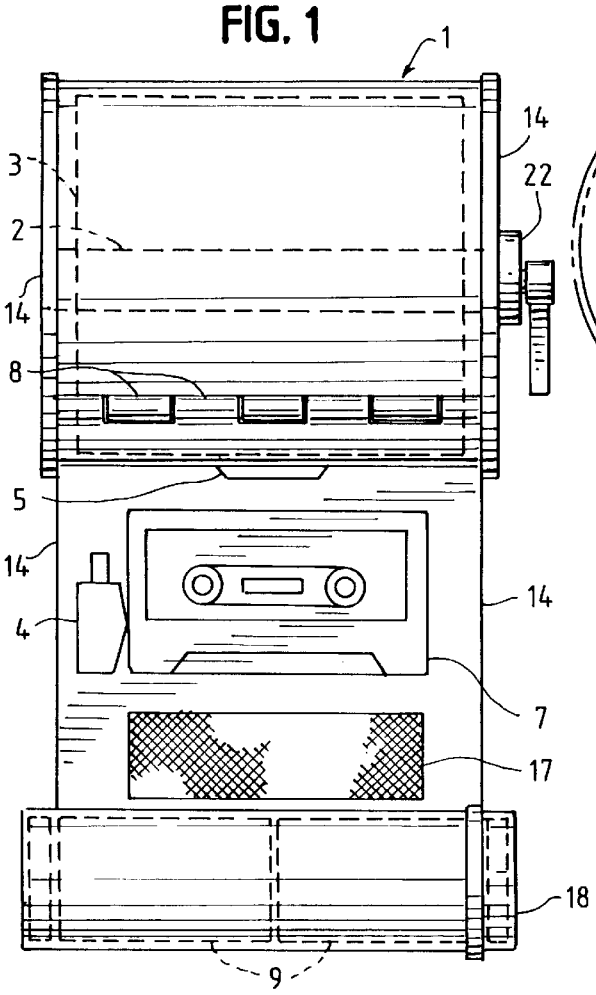
FIG. 1 is a front elevation view of a first preferred embodiment of the improved tiolet paper dispenser of the present invention.

The preferred embodiments depicted in the drawing include an improved toilet paper dispenser of the type in which a roll of toilet paper is supported on a rotatable spindle secured at each end thereof by a bracket, and wherein the improvement comprises a music box, being a tape player, a compact disc player, a computer chip properly programmed with music, or the like, operatively connected to the spindle and activated by rotation of the spindle. A timer is provided to deactivate the music box after a period of time has elapsed.

Additionally, the present invention is equipped with means for dispensing an aromatic fragrance which is operably connected to the spindle.

The improved toilet paper dispenser further comprising a nightlight operatively connected to the spindle which may be activated by rotation of the spindle. Furthermore, the night light may have an independent on/off switch.

Without departing from the generality of the invention disclosed herein, the improved toilet paper dispenser could be further combined with a reading lamp, a fan, or any other accessory desirable during use of a toilet.

The discussion that follows, without limiting the scope of the invention, will refer to the invention as depicted in the drawing, showing an improved toilet paper dispenser further comprising a wall mountable housing 1 with a pivotable cover 6. The pivotable cover provides protection for the toilet paper 3. Preferably the housing 1 is made of plastic or comparable material.

In this preferred embodiment of the present invention, means for playing music comprises an audio tape player 7 integral with the housing 1. The housing further may have a panel with at least one manually actuated switch 8. One of the at least one manually actuated button is operatively connected to one of a nightlight 5, the audio tape player 7, and means for dispensing an aromatic fragrance 4. In another preferred embodiment, the pivotable cover 6 is transparent.

Figure 2:
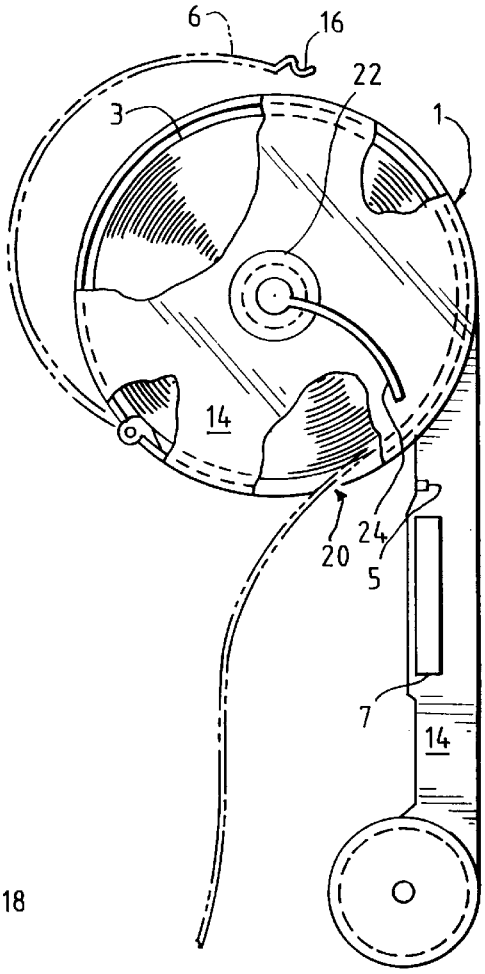
FIG. 2 is a side elevation view of the embodiment of FIG. 1 showing (in phantom) the pivotable cover partially open.

In a preferred embodiment of the present invention as shown in FIGS. 1 and 2, a bathroom fixture is disclosed comprising a housing 1, means for rotatably mounting a roll of toilet paper in the housing, a sound reproducing device mounted in the housing, the device being adapted to be energized when the roll of tissue is rotated.

Switch means 12 actuatable in response to rotation of the roll of toilet paper 3 are provided to energize the sound device. Furthermore, the housing may have an enclosure for the roll of toilet tissue.

The enclosure or housing 1 comprises a lid or cover 6 and end walls 14 having mounts or brackets 10 for rotation of a toilet paper spindle 2. A snap clasp 16 may be provided to lock the lid 6 in an operably closed position as shown in FIG. 2. Moreover, a nightlight 5 is operably disposed on the housing.

Referring to FIG. 1, a built-in spray aroma dispenser 4 is operably disposed on the housing 1.

The nightlight can be switched on or off and the entire housing can be designed to glow in the dark without the need to draw energy from the batteries 9. Obviously, the batteries could be replaced by an ac power source.

Referring now to the drawing and more particularly to FIG. 1, the bathroom fixture of the present invention is indicated generally by reference numerals includes a housing 1 for rotatable reception of a roll of toilet tissue 3 in which is mounted a music source, such as a cassette player 7 or the like, having a cassette, a speaker 17, and a battery compartment 18 in which are received a pair of batteries 9. The batteries are retained in conductive relation in the circuit by means of a spring.

The enclosure, as seen best in FIG. 2, is connected to the housing 1 and has a hinged lid 6 pivotally mounted to afford access to the interior of the housing to replace the roll of tissue 3. At the end of the lid 6 is a ridge which is adapted to cooperate with a corresponding ridge forming a snap clasp 16, at the edge of the enclosure, as seen clearly in FIG. 2. The lid 6 is forced in a clockwise direction for closing a manner that the leading edge thereof rides up over the stationary ridge of the enclosure for effective locking.

At the bottom of the housing is an opening 20 through which the tissue normally projects as illustrated in FIG. 2. The tissue roll may be mounted on a conventional roller or spindle 2 and is rotatably connected to a hub 22 which extends outwardly through end wall 14 of the housing 1. A handle 24, preferably of arcuate configuration is fixedly connected to the hub 22 and may be rotated in a clockwise direction for initiating unrolling of the tissue 3.

Referring again to FIG. 3, the present fixture also includes a light 5 in parallel (or alternatively in series) with the music box 7 and switch 12. As the switch 12 is closed for energization of the circuit upon pulling of the end of the tissue, the light 5, the music reproduction device 7, and the means for dispensing an aromatic fragrance 4 are energized. Desirably, the switch 12 remains closed for a predetermined period of time before opening automatically.

Figure 3:
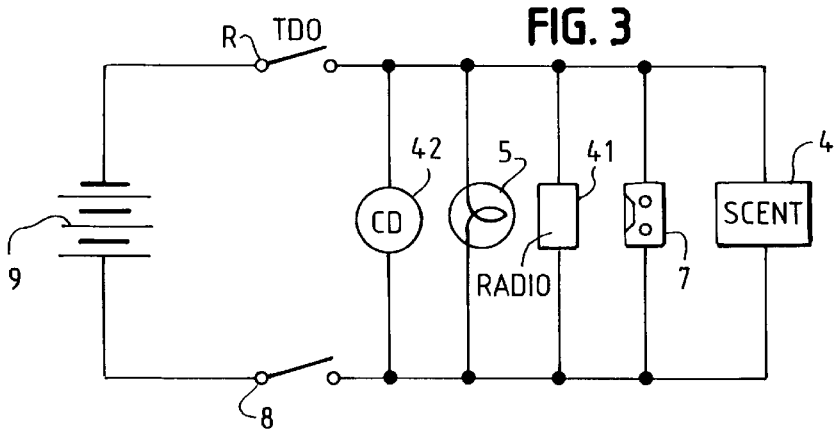
FIG. 3 is a circuit diagram illustrating a preferred embodiment of the invention showing the circuit operable to sense rotation of the spindle and actuate the light, music and fragrance dispenser with an alternative manual switch also shown.
Figure 4:
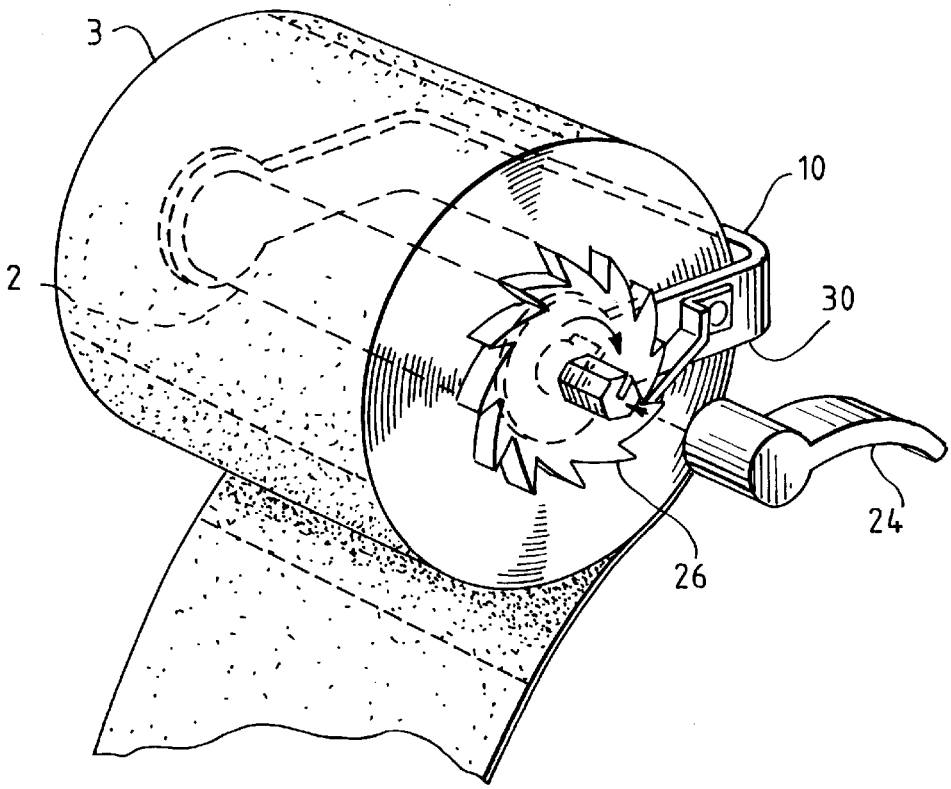
FIG. 4 is an exploded perspective view of a preferred embodiment of the improved tiolet paper dispenser of the present invention showing spindle, handle and means for ratcheting.

As best shown in FIG. 4, an improved toilet paper dispenser is disclosed herein of the type in which a roll of toilet paper 3 is supported on a rotatable spindle 2 secured at each end thereof by a bracket 10. In this improvement, as shown in FIG. 3, means for playing music, such as a audio tape player 7, is operatively connected to the spindle 2 by way of a switch 12, whereby, music is activated by rotation of the spindle 2.

In a preferred embodiment of the present invention the means for playing music further comprises a means for timing, whereby it is deactivated at a predetermined period of time following activation. A time delayed switch 12 has been provided for this function.

In another preferred embodiment of the improved toilet paper dispenser means for rotating the spindle 2 is provided. The means for rotating the spindle comprises a handle 24 extending from an arm 30 of the bracket 10. The arm has an opening 31 through which the spindle 2 is interconnected to the handle 24, and one of the spindle 2 and the handle 24 having a means for ratcheting 26, as shown in FIG. 4. In this way, music is activated by movement of the handle 24. Alternatively, the means for playing music may be operatively connected to a second means for activation. Manual engagement of the second means for actuation, such as a switch 8 may be employed.

The means for playing music may comprise an audio tape player 7, a compact disk player 42, a radio 41, or any combination thereof.

Another preferred embodiment of the present invention is equipped with means for dispensing an aromatic fragrance or scent 4 which is operably connected to the spindle 2. The aromatic fragrance may be dispensed by rotation of the spindle 4. Moreover, the means for dispensing may further comprises a second means for actuation, such as a switch 8, which is engaged manually.

As best shown in FIG. 3, the improved toilet paper dispenser further comprising a nightlight 5 operatively connected to the spindle 2 through a switch 12 which may be activated by rotation of the spindle 2. Furthermore, the nightlight 5 may have an independent on/off switch 8.

Referring to FIG. 2, the improved toilet paper dispenser further comprises a wall mountable housing 1 with a pivotable cover 6. The pivotable cover 6 provides protection for the toilet paper. In this preferred embodiment of the present invention, the means for playing music comprises an audio tape player 7 integral with the housing 1. The housing 1 further may have a panel with at least one manually actuated switch 8. One of the at least one manually actuated switch 8 is operatively connected to one of a nightlight 5, the audio tape player 7, and means for dispensing an aromatic fragrance 4. In another preferred embodiment, the pivotable cover is transparent.

Figure 5:
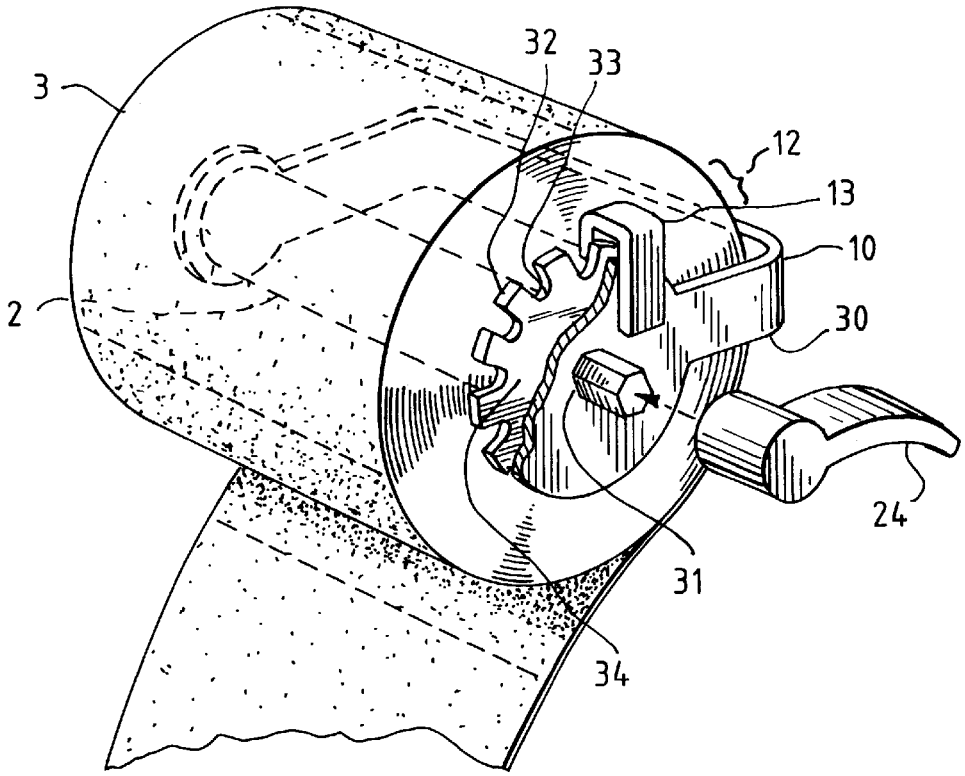
FIG. 5 is an exploded perspective view of a preferred embodiment of the improved tiolet paper dispenser of the present invention showing switch means including a dial comprising a circular encoder disc with a plurality of circumferencially spaced radially extending arms defining slots therebetween.

In a preferred embodiment of the present invention as shown in FIGS. 1–2, a bathroom fixture is disclosed comprising a housing 1, means for rotatably mounting a roll of toilet paper in the housing, a sound reproducing device mounted in the housing. The device is adapted to be energized when the roll of tissue 3 is rotated. Switch means 12 actuatable in response to rotation of the roll are provided to energize the sound device and the other accessories. One such switch means 12 includes a dial comprising a circular encoder disc 34 formed of a conductive material. The disc 34 has a plurality of circumferencially spaced radially extending arms 32 defining slots 33 therebetween, as shown in FIG. 5. An optical interrupter 13 includes two photosensing elements for sensing rotary movement of the disc 34 to detect when one of the handle 24 is moved and the spindle 2 is rotated.

Furthermore, the housing 1 may have an enclosure for the roll of toilet tissue. The enclosure comprises a lid 6 and end walls 14 having mounts for rotation of a toilet paper spindle 2. A snap clasp 16 may be provided to lock the lid 6 in an operably closed position. Moreover, a nightlight 5 is operably disposed on the housing 1.

Referring to FIG. 1, a built-in spray aroma dispenser 4 is operably disposed on the housing.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skill in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects and advantages of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. An improved toilet paper dispenser of the type, in which a roll of toilet paper is supported on a rotatable spindle secured at each end thereof by a bracket, wherein the improvement comprises:

a. means for playing music operatively connected to the spindle, whereby, music is activated by rotation of the spindle.

2. The improved toilet paper dispenser of claim 1, wherein the means for playing music further comprises a means for timing, whereby, the means for playing music is deactivated at a predetermined period of time following activation.

3. The improved toilet paper dispenser of claim 1, further comprising means for rotating the spindle.

4. The improved toilet paper dispenser of claim 3, wherein the means for rotating the spindle comprises a handle extending from an arm of the bracket, said arm having an opening through which the spindle is interconnected to the handle, one of said spindle and said handle having a means for ratcheting, whereby, music is activated by movement of the handle.

5. The improved toilet paper dispenser of claim 1, wherein the means for playing music is operatively connected to a second means for activation, whereby, music is activated by manual engagement of the second means for actuation.

6. The improved toilet paper dispenser of claim 1, wherein the means for playing music comprises an audio tape player.

7. The improved toilet paper dispenser of claim 1, wherein the means for playing music comprises a compact disk player.

8. The improved toilet paper dispenser of claim 1, wherein the means for playing music comprises a radio.

9. The improved toilet paper dispenser of claim 1, further comprising means for dispensing an aromatic fragrance which is operably connected to the spindle, whereby, the aromatic fragrance may be dispensed by rotation of the spindle.

10. The improved toilet paper dispenser of claim 9, wherein the means for dispensing further comprises a second means for actuation, whereby, the aromatic substance may be dispensed by manual engagement of the second means for actuation.

11. The improved toilet paper dispenser of claim 1, further comprising a nightlight operatively connected to the spindle, whereby, the nightlight is activated by rotation of the spindle.

12. The improved toilet paper dispenser of claim 11, wherein the night light has an independent on/off switch.

13. The improved toilet paper dispenser of claim 1, further comprising a wall mountable housing with a pivotable cover, said pivotable cover provides protection for the toilet paper, and wherein the means for playing music comprises an audio tape player integral with said housing, said housing further having a panel with at least one manually actuated button, one of said at least one manually actuated button being operatively connected to one of a nightlight, the audio tape player, and means for dispensing an aromatic fragrance.

14. The improved toilet paper dispenser of claim 13, wherein the pivotable cover is transparent.

15. An improved toilet paper dispenser in which a roll of toilet paper is supported on a rotatable spindle secured at each end thereof by a bracket, wherein the improvement comprises:

a. means for rotating the spindle;

b. means for playing music operatively connected to the means for rotating the spindle, whereby, music is activated by movement of the means for rotating the spindle.

16. A bathroom fixture comprising a housing, means is for rotatably mounting a roll of toilet paper in said housing, a sound reproducing device mounted in said housing, said device being adapted to be energized when the roll of tissue is rotated.

17. The fixture in accordance with claim 16, wherein switch means actuatable in response to rotation of said roll are provided to energize said sound device.

18. The fixture in accordance with claim 16, wherein the housing has an enclosure for the roll of toilet tissue.

19. The fixture in accordance with claim 18, wherein said enclosure comprises a lid and end walls having mounts for rotation of a toilet paper spindle.

20. The fixture in accordance with claim 19, wherein a snap clasp is provided to lock said lid in an operably closed position.

21. The fixture in accordance with claim 20, wherein a light is operably disposed on the housing.

22. The fixture in accordance with claim 20, wherein a built-in spray aroma is operably disposed on the housing.

* * * * *